US006902066B2

(12) United States Patent
Yang

(10) Patent No.: US 6,902,066 B2
(45) Date of Patent: Jun. 7, 2005

(54) REMOVAL UNIT FOR METAL ALIEN MATERIAL REMOVAL APPARATUS

(76) Inventor: Byeong Gon Yang, Sin Sung Machine, 707 Bongkac-dong, Chunlanam-do, Yosu 555-080 (KR)

( * ) Notice: Subject to any disclaimer, the term of this patent is extended or adjusted under 35 U.S.C. 154(b) by 177 days.

(21) Appl. No.: 10/296,936

(22) PCT Filed: Jun. 9, 2001

(86) PCT No.: PCT/KR01/00985

§ 371 (c)(1),
(2), (4) Date: Apr. 21, 2003

(87) PCT Pub. No.: WO01/94022

PCT Pub. Date: Dec. 13, 2001

(65) Prior Publication Data

US 2003/0173264 A1 Sep. 18, 2003

(30) Foreign Application Priority Data

Jun. 9, 2000 (KR) ..... 2000/31607

(51) Int. Cl.[7] ..... B03C 1/10

(52) U.S. Cl. ..... 209/223.1; 209/223.2; 209/228; 209/229; 210/222

(58) Field of Search ..... 209/229, 221, 209/1, 228

(56) References Cited

U.S. PATENT DOCUMENTS

| | | | | | |
|---|---|---|---|---|---|
| 2,992,734 | A | * | 7/1961 | Maynard | 209/223.1 |
| 4,394,264 | A | * | 7/1983 | Schimion et al. | 210/222 |
| 4,867,869 | A | * | 9/1989 | Barrett | 209/223.2 |
| 5,043,063 | A | * | 8/1991 | Latimer | 210/222 |
| 5,066,390 | A | * | 11/1991 | Rhodes et al. | 209/217 |
| 5,188,239 | A | * | 2/1993 | Stowe | 209/223.1 |
| 5,190,159 | A | * | 3/1993 | Barker | 209/223.2 |
| 5,316,151 | A | * | 5/1994 | Thompson | 209/223.1 |
| 5,427,249 | A | | 6/1995 | Schaaf | |
| 5,470,466 | A | * | 11/1995 | Schaaf | 210/222 |
| 5,819,949 | A | * | 10/1998 | Schaaf et al. | 209/223.2 |
| 5,982,261 | A | * | 11/1999 | Stowe | 335/306 |
| 6,077,333 | A | * | 6/2000 | Wolfs | 96/1 |
| 6,250,475 | B1 | * | 6/2001 | Kwasniewicz et al. | 209/229 |
| 6,277,276 | B1 | * | 8/2001 | Bratten | 210/223 |
| 6,355,176 | B1 | * | 3/2002 | Schaaf et al. | 210/695 |
| 6,638,425 | B2 | * | 10/2003 | Asterlin | 210/222 |

FOREIGN PATENT DOCUMENTS

| | | |
|---|---|---|
| JP | 64-83452 | 3/1989 |
| KR | 95-2860 | 2/1995 |

OTHER PUBLICATIONS

English Language Abstract of JP 64–83452.

* cited by examiner

*Primary Examiner*—Donald P. Walsh
*Assistant Examiner*—Jonathan R Miller
(74) *Attorney, Agent, or Firm*—Greenblum & Bernstein, P.L.C.

(57) ABSTRACT

Disclosed is a removal unit for removing metallic alien materials, which is adapted to remove metallic alien materials such as metal fragments contained in powder or liquid raw materials. The removal unit includes an outer plate, an inner plate spaced apart from the outer plate, and magnet members coupled between the inner and outer plates. Each magnet member includes a cylindrical stainless steel rod, a magnet received in the stainless steel rod to extend from one end of the stainless steel rod to at least an intermediate portion of the stainless steel rod, a non-magnetic piece received in the other end of the stainless steel rod and coupled to the outer plate, and a fluorine resin coating formed over an outer peripheral surface of the stainless steel rod. A removal member is arranged to be slidable in a longitudinal direction along the magnet members while being in contact with the outer peripheral surfaces of the magnet members.

2 Claims, 7 Drawing Sheets

REMOVAL UNIT FOR METAL ALIEN MATERIAL REMOVAL APPARATUS

TECHNICAL FIELD

The present invention relates to a removal unit for removing metallic alien material which is adapted to remove metallic alien materials such as metal fragments contained in powder or liquid raw materials.

BACKGROUND ART

Generally, removing apparatus for alien material used in chemical factories and plastic powder manufacturing factories serve to remove metallic alien materials contained in raw materials in order to achieve an improvement in the quality of those raw materials.

An example of a metal separation device was disclosed in U.S. Pat. No. 5,188,239 of Stowe et al. This metal separation device will be described with reference to FIG. 6.

As shown in FIG. 6, the metal separation device includes a housing 12, into which a raw material is introduced, and a bracket 30 mounted in the housing 12. The bracket 30 includes a base plate 36, leg members 40 extending from the base plate 36, and a face plate 26 coupled to the leg members 40 in such a fashion that it is integral with those leg members 40. The base plate 36 and leg members 40 are disposed in the interior of the housing 12 whereas the face plate 26 is coupled to one side wall of the housing 12. The base plate 36 and faceplate 26 are provided with holes 38 and 28, respectively. Cylindrical magnets 23 are separable inserted into the holes 38 and 28 at respective one-side ends thereof. A drawer plate 25 is coupled to the other-side ends of the magnets 23. A handle 58 is provided at the drawer plate 25.

As a raw material passes through the housing 12 under the condition in which the magnets 23 are inserted in the holes 28 and 38 of the face plate 26 and base plate 36 included in the bracket 30 fitted in the housing 12, metallic alien materials contained in the raw material are attached to outer surfaces of the magnets 23. When the operator pulls the handle 58 to draw the magnets 23 from the housing 12, the magnets 23 slide with respect to the holes 28 of the faceplate 26. Since the outer surface of each magnet 23 is in contact with the peripheral surface of an associated one of the holes 28, the metallic alien materials attached to the outer surfaces of the magnets are wiped by the peripheral surfaces of the holes 28. Thus, the metallic alien materials are removed from the outer surfaces of the magnets 23.

However, the metal separation device of Stowe et al. has the following drawbacks.

First, fine metallic alien materials attached to the magnets 23 are left without being completely removed. For this reason, a separate manual process using an adhesive tape or the like should be conducted in order to remove such fine metallic alien materials.

In addition, a lot of time is taken for the manual process, thereby resulting in degradation in productivity.

After the magnets 23 are separated from the bracket 30, they should be inserted again into the bracket 30. However, it is difficult to insert the magnets 23 into the holes 28 and 38 of the bracket 30 by virtue of the magnetic force of the magnets 23. In other words, the free end of each magnet 23 cannot be easily inserted into the hole 28 or 38 of the bracket 30 because the fundamental magnet characteristics, that is, an attraction exhibited between magnets having the same polarity and a repulsion exhibited between magnets having different polarities.

DISCLOSURE OF THE INVENTION

The present invention has been invented in view of solving the above mentioned drawbacks involved in the related art, and the object of the invention is to provide a removal apparatus for removing metallic alien material which is installed around a magnet to wipe metallic alien materials attached to the surface of the magnet toward an end of the magnet while sliding along the magnet, thereby allowing the metallic alien materials to be automatically separated from the magnet, so that it is possible to easily and conveniently remove the metallic alien materials from the magnet.

In accordance with the present invention, this object is accomplished by providing removing metallic alien material comprising a body into which a raw material containing metallic alien materials are introduced and from which the raw material is discharged. The removal unit including an outer plate provided with handles, an inner plate spaced apart from the outer plate by a desired distance, and magnet members coupled between the inner plate and the outer plate, so that the metallic alien materials are attached to outer peripheral surfaces of the magnetic members, and then removed,.

Wherein each of the magnet members included in the removal unit includes a cylindrical stainless steel rod, a magnet received in the stainless steel rod to extend from one end of the stainless steel rod to at least an intermediate portion of the stainless steel rod, the magnet being coupled to the inner plate, a non-magnetic piece received in the other end of the stainless steel rod and coupled to the outer plate, and a fluorine resin coating formed over an outer peripheral surface of the stainless steel rod; and further comprising:

a removal member arranged to be slidable in a longitudinal direction along the magnet members while being in contact with the outer peripheral surfaces of the magnet members, the removal member serving to wipe the metallic alien materials attached to the outer peripheral surface of the stainless steel rod at a portion of the stainless steel rod, in which the magnet is received, toward the end of the stainless steel rod in which the non-magnetic piece is received.

The removal member comprises removal rings each fitted around the stainless steel rod of an associated one of the magnet members and adapted to wipe metallic alien materials attached to the outer peripheral surface of the stainless steel rod while moving in a longitudinal direction along the stainless steel rod, a fixed plate provided with insertion holes for receiving the removal rings, respectively, the fixed plate serving to prevent the removal rings from moving radial of the associated stainless steel rods, and support plates coupled to both surfaces of the fixed plate, respectively, while covering the removal rings, the support plates firmly supporting the removal rings so that the removal rings are firmly held on the fixed plate.

BRIEF DESCRIPTION OF THE DRAWINGS

The above objects, other features and advantages of the present invention will become more apparent after a reading of the following detailed description when taken in conjunction with the drawings, in which.

BEST MODE FOR CARRYING OUT THE INVENTION

Now, a removal unit for removing metallic alien materials according to an embodiment of the present invention will be described in conjunction with the annexed drawings.

Figure 1:
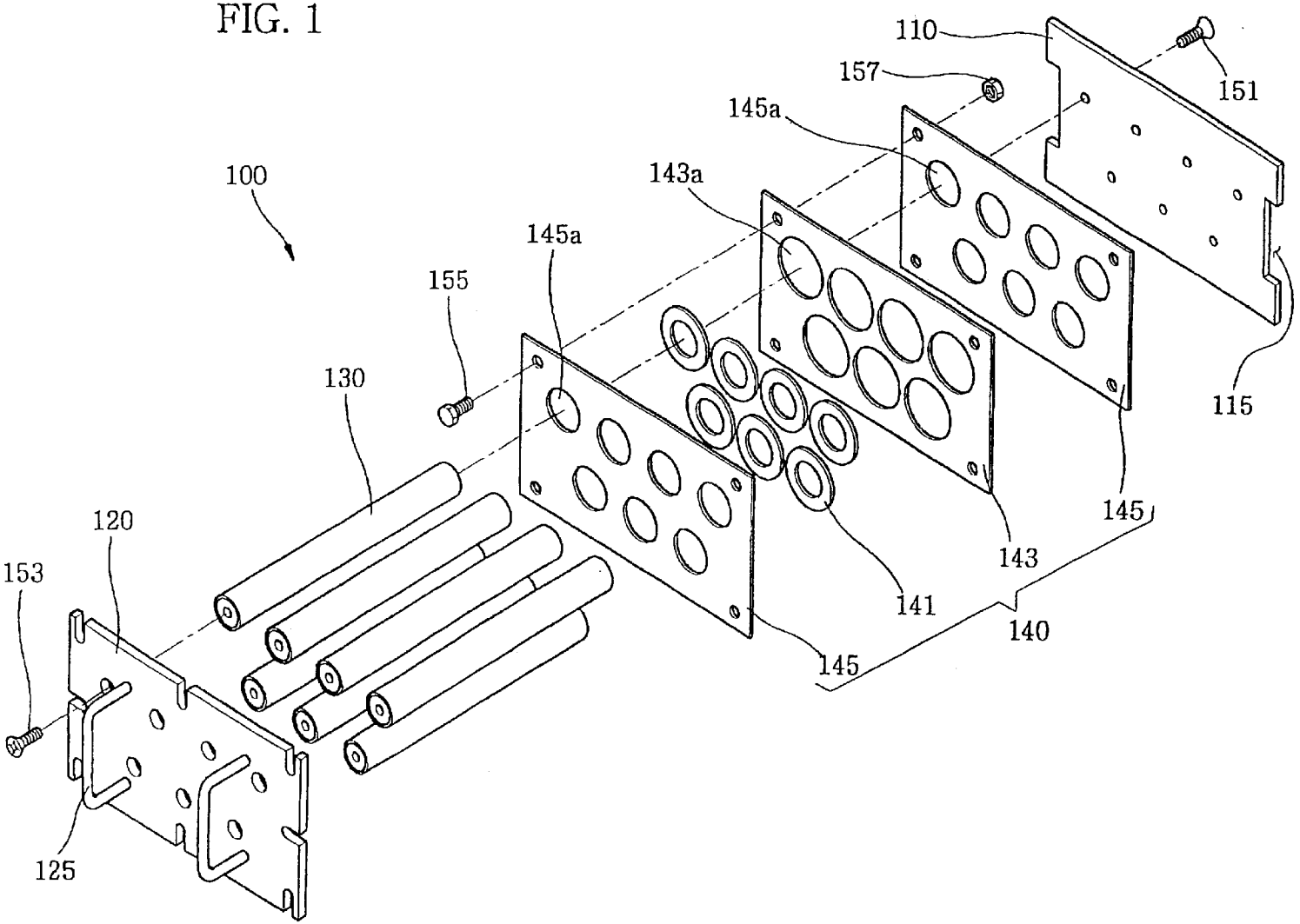
FIG. 1 is an exploded perspective view illustrating a removal unit for removing metallic alien material according to an embodiment of the present invention.
Figure 2:
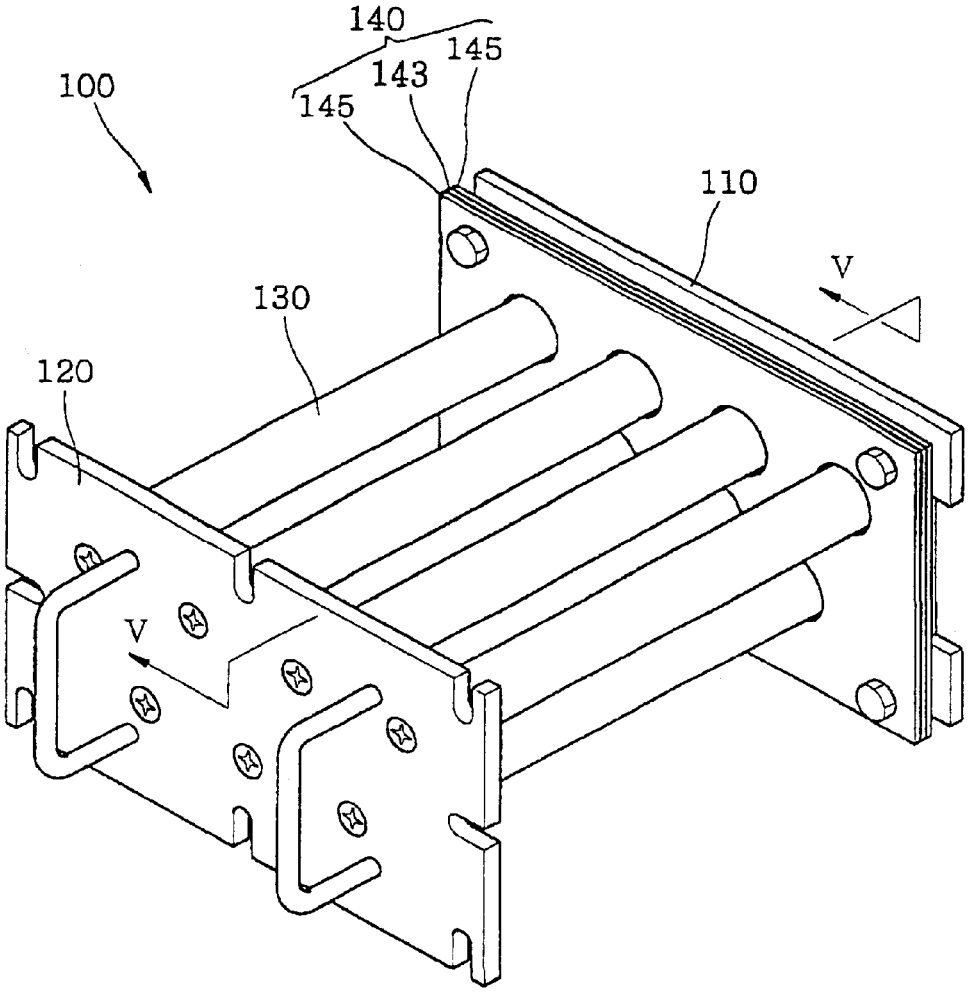
FIG. 2 is an assembled perspective view corresponding to FIG. 1.
Figure 3:
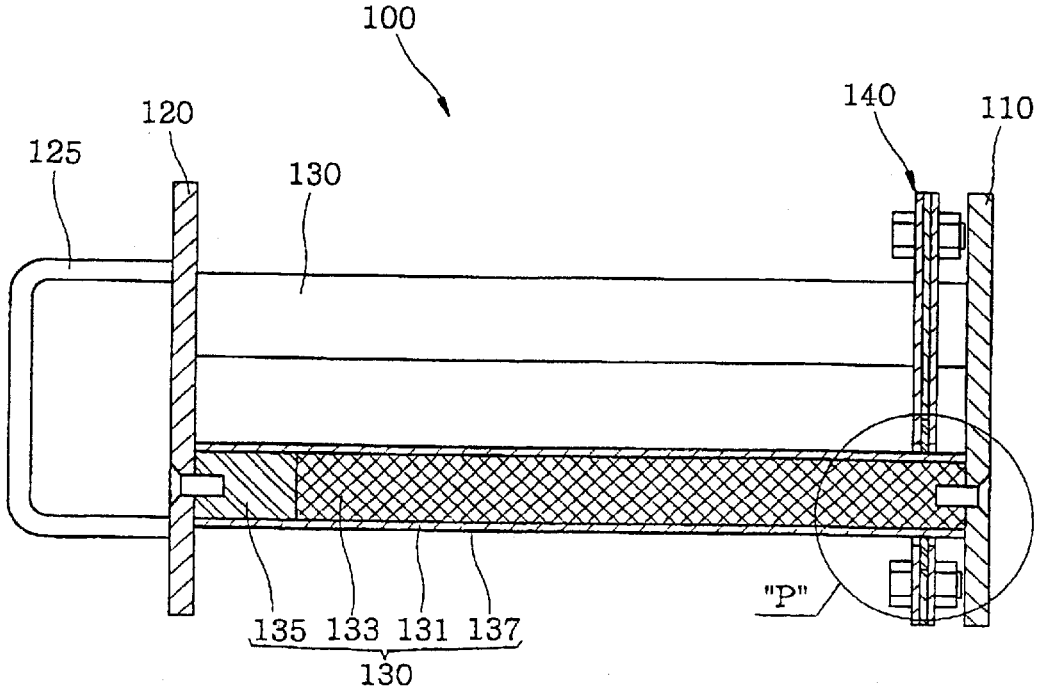
FIG. 3 is a cross-sectional view taken along the line V—V of FIG. 2.
Figure 4:
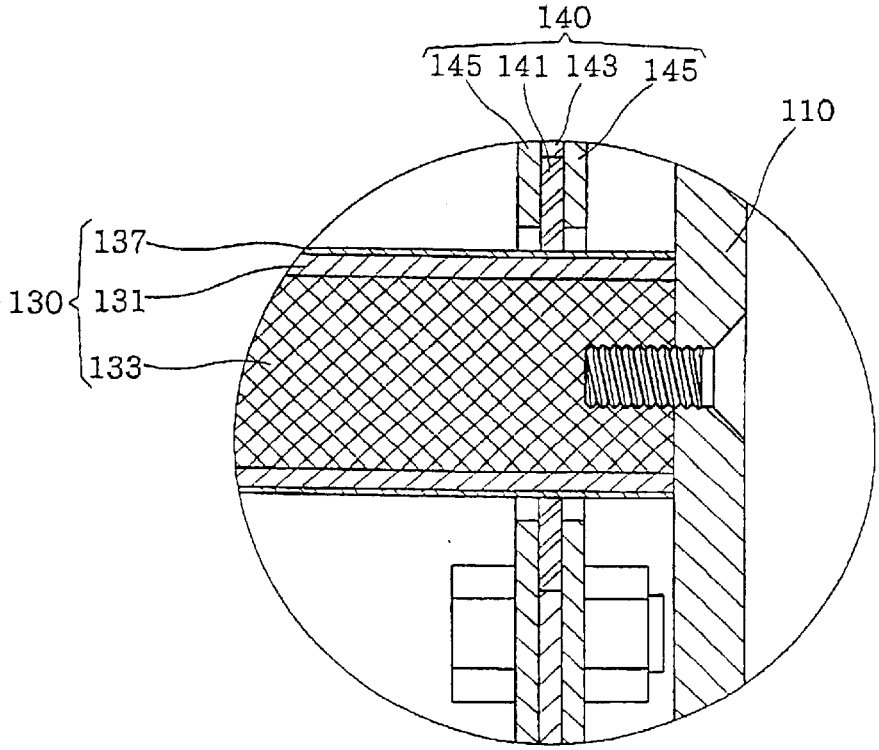
FIG. 4 is an enlarged view corresponding to a portion "P" of FIG. 3.

FIG. 1 is an exploded perspective view illustrating a removal unit for removing metallic alien materials according to an embodiment of the present invention. FIG. 2 is an assembled perspective view corresponding to FIG. 1. FIG. 3 is a cross-sectional view taken along the line V—V of FIG. 2. FIG. 4 is an enlarged view corresponding to a portion "P" of FIG. 3.

Figure 5A:
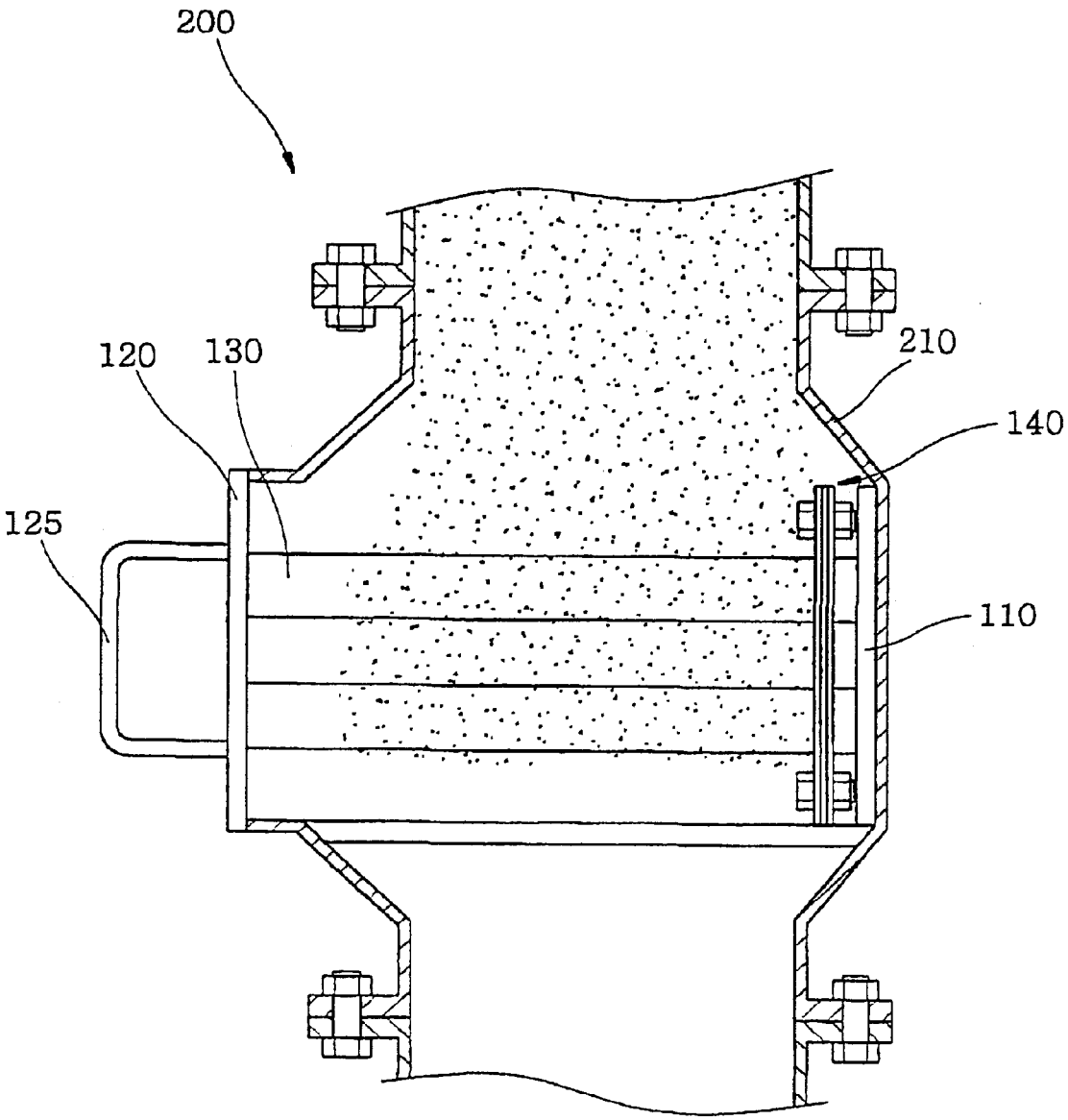
FIGS. 5A, 5B, and 5C are views illustrating the using states of the removal unit according to the present invention which is installed in removing metallic alien materials, respectively.

As shown in FIGS. 1 to 4, the removal unit of the present invention, which is denoted by the reference numeral 100, serves to remove metallic alien materials contained in a raw material passing through the body 210 of a metallic alien material removal device 200 (FIG. 5A). The removal unit 100 has an inner plate 110, an outer plate 120, a magnet member, 130, and a removal member 140.

The inner and outer plates 110 and 120 are spaced apart from each other by a desired distance. Magnet members 130 are coupled between the inner and outer plates 110 and 120 in such a fashion that each of them is coupled at one end thereof to the inner plate 110 and at the other end thereof to the outer plate 120 by bolts 151 and 153, respectively.

Each magnet member 130 includes a cylindrical stainless steel rod 131, a magnet 133 received in the stainless steel rod 131 to extend from one end of the stainless steel rod 131 to at least an intermediate portion of the stainless steel rod 131, a non-magnetic piece 135 received in the other end of the stainless steel rod 131, and a fluorine resin coating 137 formed over the outer peripheral surface of the stainless steel rod 131. The magnet 133 is coupled to the inner plate 110 whereas the non-magnetic piece 135 is coupled to the outer plate 120.

The removal member 140 is slidable along the length of the magnet members 130 while being in contact with the outer peripheral surface of each magnet member 130. The fluorine resin coating 137 serves to reduce a friction generated between the associated magnet member 130 and the removal member 140, thereby allowing the removal member 140 to easily slide along the length of the magnet member 130 while achieving an improvement in durability for the magnet member 130 and removal member 140.

The removal member 140 includes removal rings 141, a fixed plate 143, and a pair of support plates 145. The inner peripheral surface of each removal ring 141 is in close contact with the outer peripheral surface of an associated one of the magnet members 130. Accordingly, the removal ring 141 serves to wipe metallic alien materials attached to the outer peripheral surface of the associated magnet member 130. Insertion holes 143*a* having the same diameter as the outer diameter of the removal rings 141 is formed at the fixed plate 143. Each removal ring 141 is fitted in an associated one of the insertion holes 143*a*. Accordingly, each removal ring 141 is prevented from moving radial of the associated magnet member 130, by the fixed plate 143.

The support plates 145 are coupled to both surfaces of the fixed plate 143, respectively, while covering the removal rings 141. Accordingly, the support plates 145 firmly support the removal rings 141 so that the removal rings 141 are firmly held on the fixed plate 143. Each support plate 145 has holes 145*a* corresponding to respective insertion holes 143*a*. The holes 145*a* have a diameter larger than the inner diameter of the removal rings 141, but smaller than the outer diameter of the removal rings 141.

By virtue of the above mentioned configuration, when the removal member 140 slides along the length of the magnet members 130, wipes metallic alien materials attached to the outer peripheral surface of each stainless steel rod 131 toward the end of the stainless steel rod 131 in which the non-magnetic piece 135 is received. When the metallic alien materials reaching the end of the stainless steel rod 131, in which the nonmagnetic piece 135 is received, they are automatically separated from the magnet member 130 by virtue of the non-magnetic piece 135.

In the drawings, the reference numerals 115 and 125 denote grooves formed at the inner plate 110 and handles provided at the outer plate 120, respectively. The reference numerals 155 and 157 denote bolts and nuts for coupling the fixed plate 143 and support plates 145 together.

Now, the operation of the removal unit according to the present invention will be described in conjunction with FIGS. 3 to 5C. FIGS. 5A and 5C are views illustrating the using states of the removal unit according to the present invention which is installed in removing metallic alien materials, respectively.

As shown in FIG. 5A, the removal unit 100 is first inserted into the body 210 of the removing device 200. In this state, a raw material is introduced into the body 210, and allowed to pass through the body 210. As the raw material passes through the body 210, metallic alien materials contained in the raw material are attached to the outer peripheral surface of each magnet member 130 by virtue of the magnetic force of the magnet 133 received in the magnet member 130.

Figure 5B:
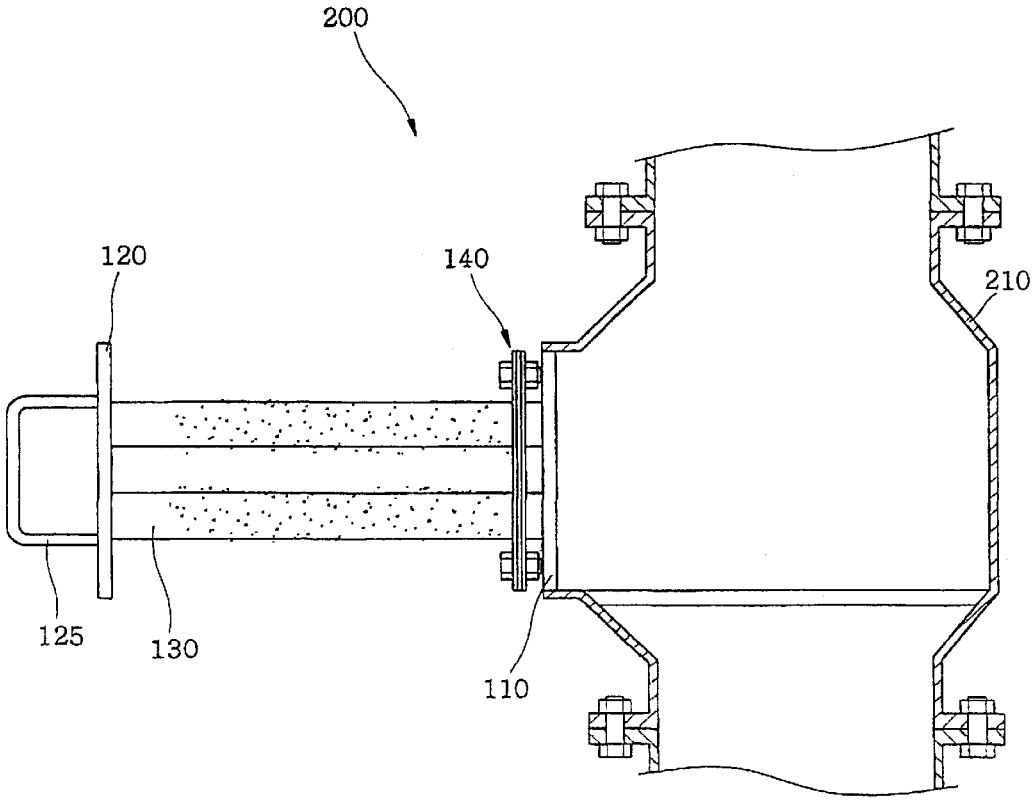
Figure 5C:
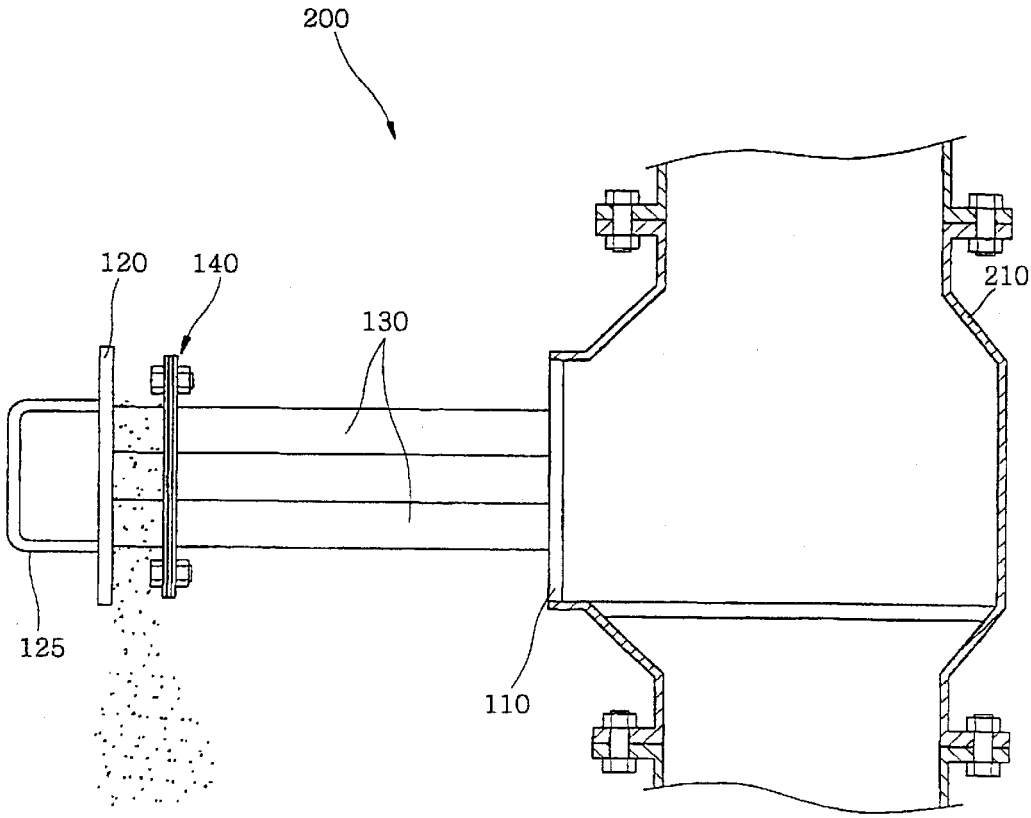
Figure 6:
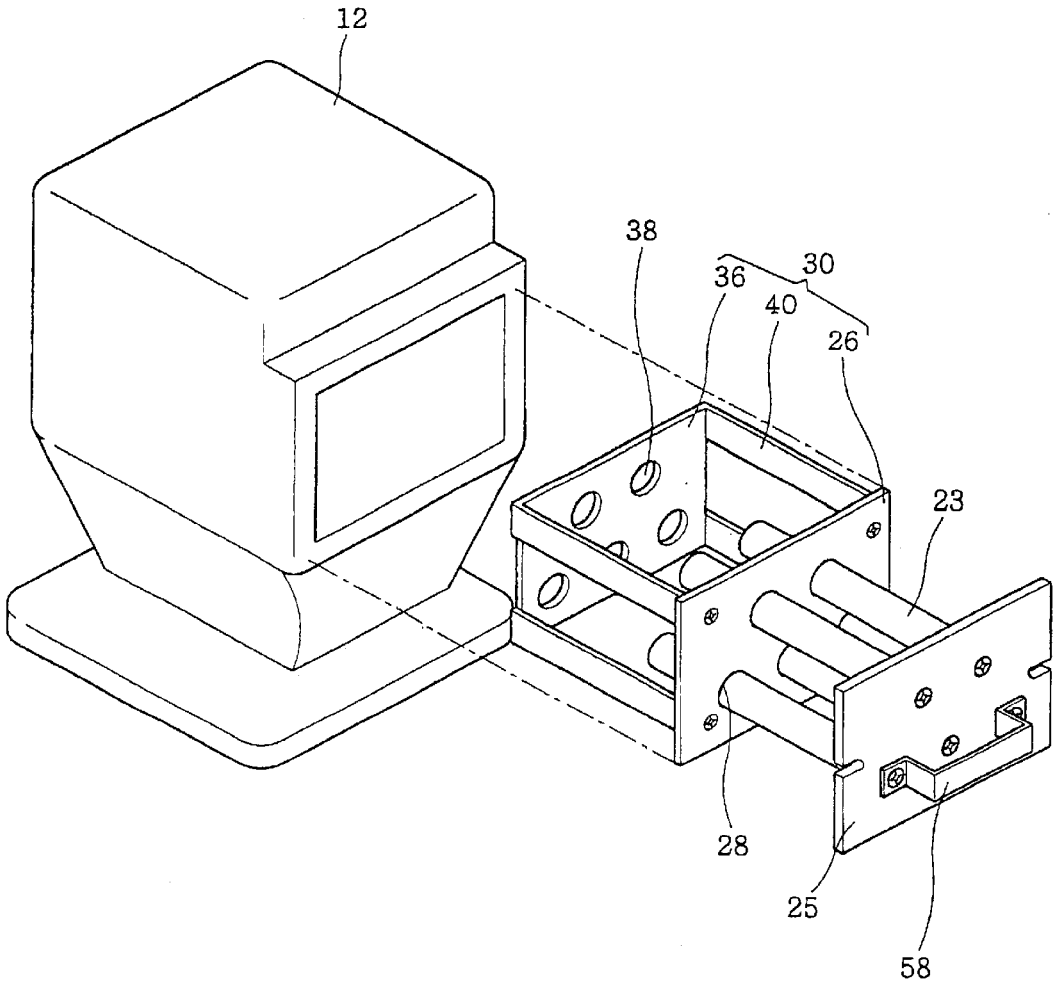
FIG. 6 (PRIOR ART)
FIG. 6 is a perspective view illustrating a conventional metal separation device.

Thereafter, the operator pulls the handles 115 to separate the removal unit 100 from the body 210, as shown in FIG. 5B. The operator then slides the removal member 140 toward the outer plate 120. As the removal member 140 slides, it wipes the metallic alien materials attached to the outer peripheral surface of each stainless steel rod 131 toward the end of the stainless steel rod 131 in which the non-magnetic piece 135 is received, as shown in FIG. 5C. When the metallic alien materials reaching the end of the stainless steel rod 131, in which the non-magnetic piece 135 is received, they are automatically separated from the magnet member 130 by virtue of the non-magnetic piece 135.

The removal unit for removing metallic alien materials according to the illustrated embodiment of the present invention may be automatically operated. That is, where an air cylinder (not shown) is installed to move the removal unit 100 accessible to the body 210 and the removal member 140 slidable in a longitudinal direction with respect to the magnet members 130, it is possible to automatically remove metallic alien materials.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

Industrial Applicability

As apparent from the above description, in the removal unit for removing metallic alien materials according to the present invention, once metallic alien materials attached to the outer peripheral surface of each stainless steel rod at a portion of the stainless steel rod, in which a magnet is received, are wiped toward the end of the stainless steel rod, in which a non-magnetic piece is received, they are automatically separated from the magnet member by virtue of the non-magnetic piece. Thus, it is possible to rapidly and conveniently remove metallic alien materials. As a result, it is possible to achieve a reduction in processing time and an improvement in productivity.

What is claimed is:

1. A removal unit for metal alien removal apparatus, having a body into which a raw material containing metallic alien materials are introduced and from which the raw material is discharged, and a removal unit including an outer plate provided with handles, an inner plate spaced apart from the outer plate by a desired distance, and magnet members coupled between the inner plate and the outer plate, so that the metallic alien materials are attached to outer peripheral surfaces of the magnetic members, and then removed, characterized in that each of the magnet members included in the removal unit includes a cylindrical stainless steel rod, a magnet received in the stainless steel rod to extend from one end of the stainless steel rod to at least an intermediate portion of the stainless steel rod, the magnet being coupled to the inner plate, a non-magnetic piece received in the other end of the stainless steel rod and coupled to the outer plate, and a fluorine resin coating formed over an outer peripheral surface of the stainless steel rod; and further having a removal member arranged to be slidable in a longitudinal direction along the magnet members while being in contact with the outer peripheral surfaces of the magnet members, the removal member serving to wipe the metallic alien materials attached to the outer peripheral surface of the stainless steel rod at a portion of the stainless steel rod, in which the magnet is received, toward the end of the stainless steel rod in which the non-magnetic piece is received.

2. The removal unit for metal alien removal apparatus as claimed in claim 1, characterized in that the above removal member having removal rings each fitted around the stainless steel rod of an associated one of the magnet members and adapted to wipe metallic alien materials attached to the outer peripheral surface of the stainless steel rod while moving in a longitudinal direction along the stainless steel rod, a fixed plate provided with insertion holes for receiving the removal rings, respectively, the fixed plate serving to prevent the removal rings from moving radial of the associated stainless steel rods and support plates coupled to both surfaces of the fixed plate, respectively, while covering the removal rings, the support plates firmly supporting the removal rings so that the removal rings are firmly held on the fixed plate.

* * * * *